United States Patent [19]

Wilson

[11] 4,335,520

[45] Jun. 22, 1982

[54] SURVEY SPAR SYSTEM FOR PRECISION OFFSHORE SEAFLOOR SURVEYS

[75] Inventor: Jeffrey V. Wilson, Camarillo, Calif.

[73] Assignee: The United States of America as represented by the Secretary of the Navy, Washington, D.C.

[21] Appl. No.: 189,245

[22] Filed: Sep. 22, 1980

[51] Int. Cl.[3] ..... E21B 47/022

[52] U.S. Cl. ..... 33/312; 33/313; 405/202

[58] Field of Search ..... 405/195, 202, 224; 9/8 P; 33/312, 313; 73/290

[56] References Cited

U.S. PATENT DOCUMENTS

| | | | |
|---|---|---|---|
| 3,720,066 | 3/1973 | Vilain | 405/202 |
| 3,862,499 | 1/1975 | Isham et al. | 33/312 |
| 3,935,642 | 2/1976 | Russel | 33/312 X |
| 4,040,189 | 8/1977 | LaCaste | 33/313 X |
| 4,127,991 | 12/1978 | Regan | 405/202 |

*Primary Examiner*—David H. Corbin
*Assistant Examiner*—Nancy J. Pistel
*Attorney, Agent, or Firm*—Robert F. Beers; Joseph M. St. Amand; Wm. C. Daubenspeck

[57] ABSTRACT

A stiff, straight spar is allowed to pivot about an anchor on the seafloor. The location of the bottom with respect to the top is then determined by measuring the tilt of the spar and computing the offset of the bottom relative to the top. The straight member uses its internal buoyancy to remain erect and stable while the weight of the anchor keeps it in place on the seafloor. The top of the spar is tracked by shore stations while the tilt and heading of the spar is monitored by an instrumentation system. Simultaneous readings of the shore instruments and the spar's tilt and heading indicators allow direct determination of the anchor location relative to the shore. An air ballast control enables the apparatus to be easily maneuvered on the ocean bottom by divers or on the surface and an internal plumb bob system allows calibration of the overall system.

11 Claims, 5 Drawing Figures

SURVEY SPAR SYSTEM FOR PRECISION OFFSHORE SEAFLOOR SURVEYS

BACKGROUND OF THE INVENTION

This invention relates in general to the field of seafloor surveying, and in particular, to apparatus for coupling conventional surface survey systems to the seafloor without loss of accuracy.

The need to accurately locate positions on the seafloor in the nearshore, diver-depth regime is not new. Moorings, piers, pipelines, cables, tracking ranges, oceanographic instrumentation and more recently offshore oil production facilities all require an accurate knowledge of both geographic and relative locations of points on the seafloor. Obtaining this data with high confidence requires three basic steps: determination of the location of a point on the sea surface; establishment of ocean bottom control; and traverse and profile of the seafloor.

Many nearshore survey systems, such as optical theodolites, laser systems, and electronic navigation systems, are available which can determine the locations of a point on the surface of the sea very accurately (within a few inches or feet). However, the process of establishing ocean bottom control, that is, accurately translating a surveyed surface position to a seafloor position, has been the weak link in this technology. There has been no practical way to translate the accurate surface datum to the seafloor even if it were just a few feet below the surface.

Free-fall devices and similar plumb-line techniques although universally used in land surveying do not reliably mark the point directly below except for very shallow water and ideal wave and current conditions. Optical and acoustic techniques have also been used in underwater surveying but these also present problems. The underwater lasers are limited in useful range and have not been developed to accuracies of better than about ±2 feet at depths of 60 to 80 feet. The accuracy of conventional sonar systems depends on a knowledge of the local velocity of sound through the water and on the presence of an accurate benchmark. The sonar systems are accurate to only about ±1 foot at the depths and ranges of interest in offshore surveying. Fixed rigid towers have been used but these are very clumsy and expensive to build and handle in more than a few feet of water.

SUMMARY OF THE INVENTION

It is therefore an object of the present invention to provide a system for translating a surveyed surface position to a seafloor position are vice versa.

Another object of the present invention to provide such a system for establishing ocean bottom control which is accurate to a few inches in depths of up to approximately 200 feet.

Another object of the present invention is to provide a system which may be used to determine the location of a point on the ocean's bottom or to actually place a marker at a desired location.

A further object of the present invention is to provide a system for establishing ocean bottom control which does not require a knowledge of currents or other sea conditions except a general knowledge of the water depth at the survey point.

Still further objects of the present invention are to provide a system for establishing ocean bottom control which is portable and self-contained, reuseable, relatively inexpensive, insensitive to construction errors or tolerance buildups, and useable with a variety of surface craft.

These and other objects are accomplished by using a stiff, straight spar which is allowed to pivot about an anchor on the seafloor. The location of the bottom with respect to the top is then determined by measuring the tilt of the spar and computing the offset of the bottom relative to the top. The straight member uses its internal buoyancy to remain erect and stable while the weight of the anchor keeps it in place on the seafloor. The top of the spar is tracked by shore stations while the tilt and heading of the spar is monitored by an instrumentation system. Simultaneous readings of the shore instruments and the spar's tilt and heading indicators allow direct determination of the anchor location relative to the shore. An air ballast control enables the apparatus to be easily maneuvered on the ocean bottom by divers or on the surface and an internal plumb bob system allows calibration of the overall system.

Other advantages and features of the present invention will become apparent from the following detailed description when considered in conjunction with the accompanying drawing, wherein like reference characters represent like parts throughout the several views and wherein:

DESCRIPTION OF THE PREFERRED EMBODIMENT

Figure 1:
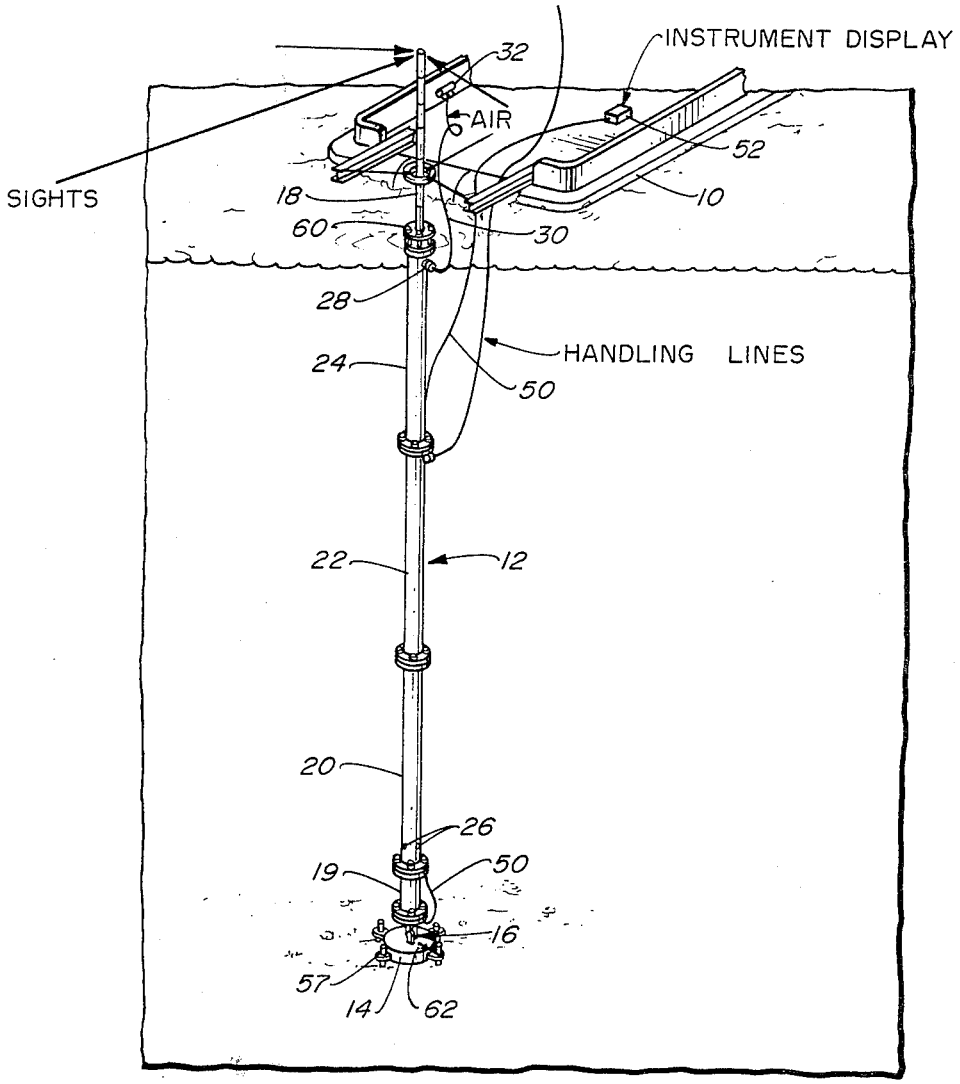
FIG. 1 is a pictorial view of an embodiment of the survey spar system deployed over the side of a surface support ship.

Referring now to the drawing, FIG. 1 shows an embodiment of the survey spar system in operation over the side of a surface support craft 10. The survey spar system includes a rigid or nearly rigid, straight tubular member 12 which is coupled to an anchor 14 by a universal joint 16 (best shown in FIG. 2). The other end of the tubular member 12 is rigidly joined to a mast 18 which continues the straight line path of the tubular member. An instrument package, which will be described hereinafter, for monitoring the orientation of the spar system is disposed in a water-tight housing 19 at the lower end of the tubular member 12. The tubular member 12, typically will be formed from a plurality of pipe sections, such as sections 20, 22 and 24 (which may have varying lengths), to provide a straight stiff member having a length in the general range of the water depth at the intended survey point. The tubular member 12 must be stiff enough to closely approximate a straight line in the presence of bending forces from current drag and wave action. As will become apparent when the preferred method of deployment is described, the tubular member 12 must be strong enough to be handled vertically and horizontally ashore and at sea.

The tubular member 12 is provided with vent holes 26 near the lower end to permit free-flooding of the interior. The upper end of the tubular member 12 is provided with an air hose coupling 28 to permit air pressure to be used to adjust the buoyancy of the survey spar system by watering or dewatering the interior of the tubular member. An air hose 30 is coupled between the air hose coupling 28 and a source of pressurized air 32 located on the surface support craft 10. The spar system preferably has a weight-to-displacement ratio to allow substantial in-water weight when flooded but at least a neutral buoyancy when fully dewatered.

Figure 2:
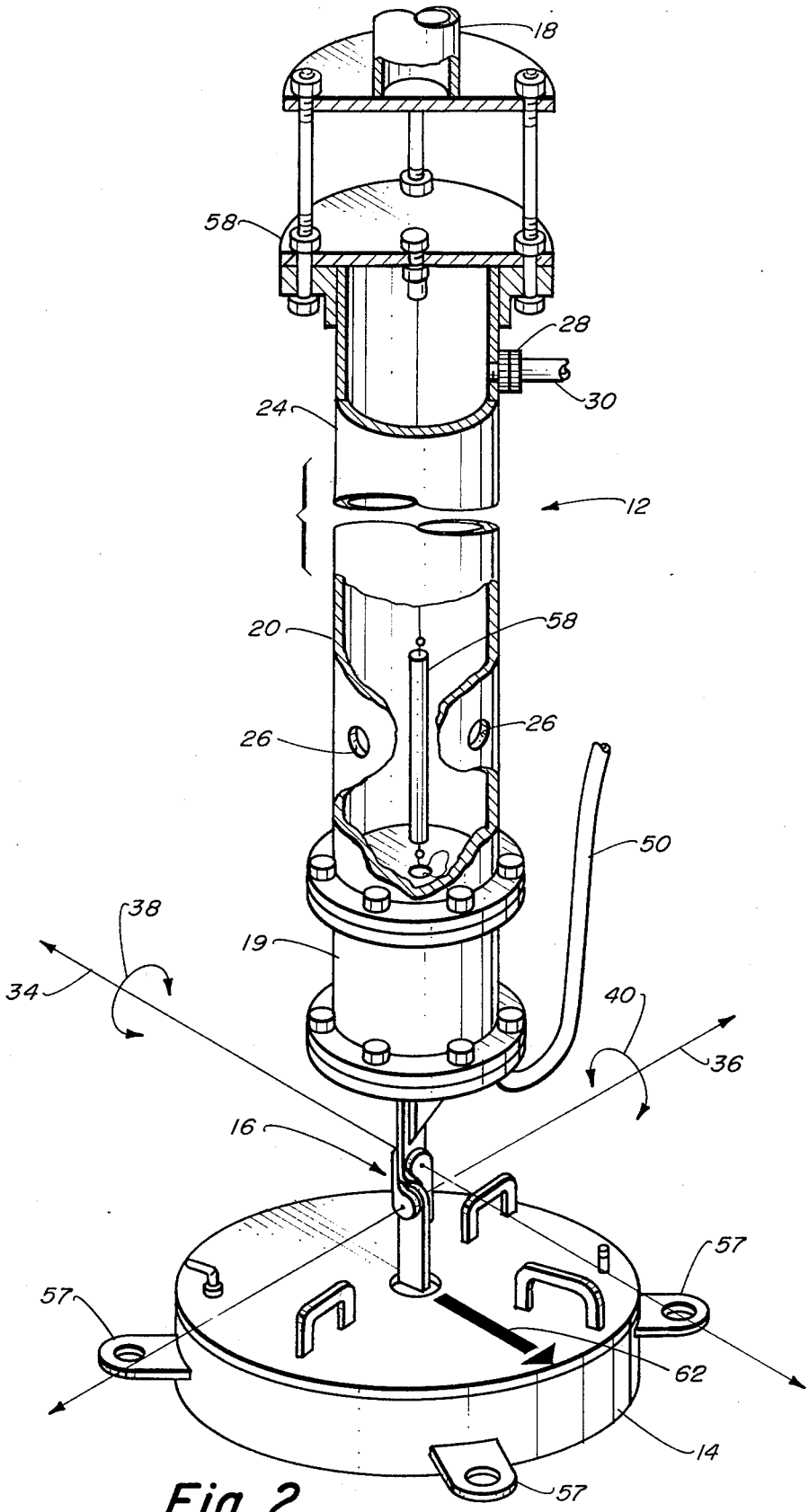
FIG. 2 is a partially broken-away, partially cross-sectional view of the upper and lower ends of the survey spar system.

Referring now to FIG. 2, which shows more detailed views of the upper and lower ends of the tubular member and the connections thereto, the universal joint 16 transmits torsion and tension loads between the tubular member 12 and the anchor 14 but permits rotation about axis 34 and orthogonal axis 36 (as indicated by arrows 38 and 40, respectively) to decouple beam loads. Thus, the tubular member 12 and attached mast 18 are free to tilt relative to the anchor 14 but are constrained so that no rotational movement is permitted about the longitudinal axis of the tubular member. A Universal Decoupler DCPL-3 of Deep Ocean Work Systems of San Pedro, Calif., is suitable for use as universal joint 16.

Figure 3:
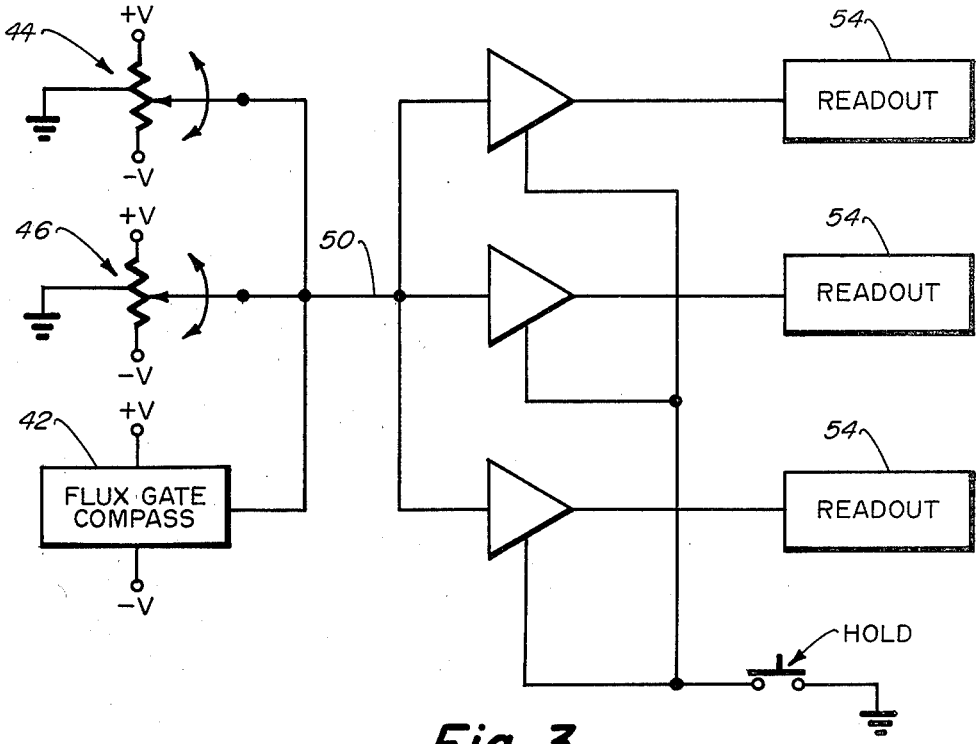
FIG. 3 is an electrical schematic drawing of the instrumentation system for monitoring the heading and tilt of the survey spar system.

The sensors for determining the heading and tilt of the spar system are disposed in the housing 19. The three sensors, which are illustrated in the electrical schematic drawing of FIG. 3, include a solid state flux compass 42 for determining the heading and two inclinometers 44 and 46 (pendulum potentiometers) for measuring the tilt of the tubular member 12. The inclinometers 44 and 46 are oriented at 90° with respect to each other and are disposed so that they measure the angular displacement of the system in the pair of orthogonal vertical planes defined by the axes 34 and 36.

The inclinometers are electrically coupled via an electro-ocean-waterproof connector (not shown) and a waterproof cable 50 to a display device 52 (see FIG. 1) on the support ship 10. The display device includes a digital readout 54 to display the sensor measurements and a sample and hold means (see FIG. 3) to freeze the measurements at a desired instant in time. The survey spar system must be constructed of non-magnetic material to ensure the proper operation of the flux compass 42. Aluminum is a preferred material because it is non-magnetic, light weight, strong, and non-corrosive in sea water.

The anchor 14 (best shown in FIG. 2) provides the minimum in-water weight needed to ensure that the spar system does not drag laterally in the presence of currents and waves. The anchor is designed with a low profile so that the pivot point of the universal joint 16 is close to the ocean bottom. Generally, the anchor will be an aluminum shell filled with concrete and/or non-magnetic metal scrap to provide the necessary weight without influencing the reading of the magnetic compass 42. However, clearances required to allow the tubular member 12 to lay down horizontally mean that the universal joint (pivot point) must be some short distance above the ocean bottom. Therefore, if the anchor 14 is not level on the ocean bottom, the pivot point may not be directly above the center of the anchor. The anchor is also provided with guides 57 to enable divers to drive stakes to mark a position on the ocean bottom. The divers may also estimate the tilt of the anchor 14 to allow a computation which will correct for the errors caused by the bottom irregularities.

The mast 18 is the portion of the spar system which projects above the water and provides the visual target for the survey from shore. It should be as light as possible to reduce the overturning moment on the spar but must be straight, rigid and strong enough to tolerate handling. In some cases the spar is actually tended from the mast so that the mast must withstand bending moments caused by current drag.

A plumb bob 58 is suspended from the center of the top plate 60 of the tubular member 12. The plumb bob 58 hangs freely inside the tubular member 12 to the vent holes 26 at the lower end which serve as viewing ports. As will be explained later, the plumb bob is used to calibrate the system prior to deployment in the ocean.

In a typical application the survey spar system will be transported to the work site in a disassembled condition (i.e., the tubular sections 20, 22 and 24 and the mast will be disconnected in order to simplify the handling). The spar system is then assembled on land. The entire system is zeroed and calibrated by actually erecting the spar system on land and stabilizing the top with adjustable guy wires or other means. The plumb bob which is suspended from the center of the top of the tubular section 12 may then be viewed through the vent holes 26. By adjusting the guy wires to center the plumb bob 58 and then zeroing the tilt potentiometers 44 and 46, it can be established that the top of the tubular section 12 is vertically over the base, regardless of a curvature in the assembly.

The sign conventions and general magnitude of the sensor readings may be checked by leaning the spar system in various directions (by moving the top or the bottom), computing its movement from instrument readings and then comparing that with movement of the shadow of the spar's top for displacement of a few feet or the plumb bob 58 inside the tubular section 12 for displacements of a few inches.

The compass 42 is checked by visually comparing the external orientation reference work heading 62 (see FIG. 2) with the compass reading.

The survey spar system is then transported to the survey site typically having been loaded on board a ship and laid horizontal on the deck. When first deployed into the water, the spar system should be lowered slowly to allow trapped air to escape from the tubular section 12 via the air hose 30. This will ensure that the spar system will stay vertical during deployment. As the survey spar system is flooded with water through the vent holes 26 at the bottom of the tubular member 12, it will settle to the bottom with the weight of the anchor 14 and the flooded column providing resistance to any drag forces so that the anchor will remain at a fixed position on the ocean floor. The air bubble captured in the tubular member 12 provides the buoyancy to hold the spar system erect and stable.

As shown in FIG. 1, with the anchor 14 resting on the bottom, the mast 18 extends through the water's surface to a height that allows determination of the position of the top of the mast by a conventional shore-based survey system. Simultaneous readings are then taken by shore-based survey instruments of the position of the mast top and of the tilt and heading of the spar system by the spar's sensors. The position of the anchor relative to the shore can be determined from these readings. With several repetitions, a statistical spread can be obtained and the mean anchor position determined.

Figure 4:
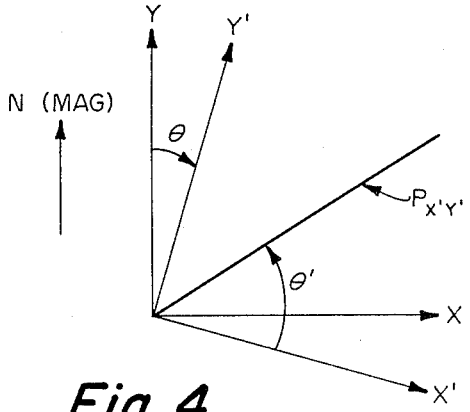
FIGS. 4 and 5 are geometric diagrams illustrating the determination of the location of the bottom of the survey spar relative to the top of the spar.
Figure 5:
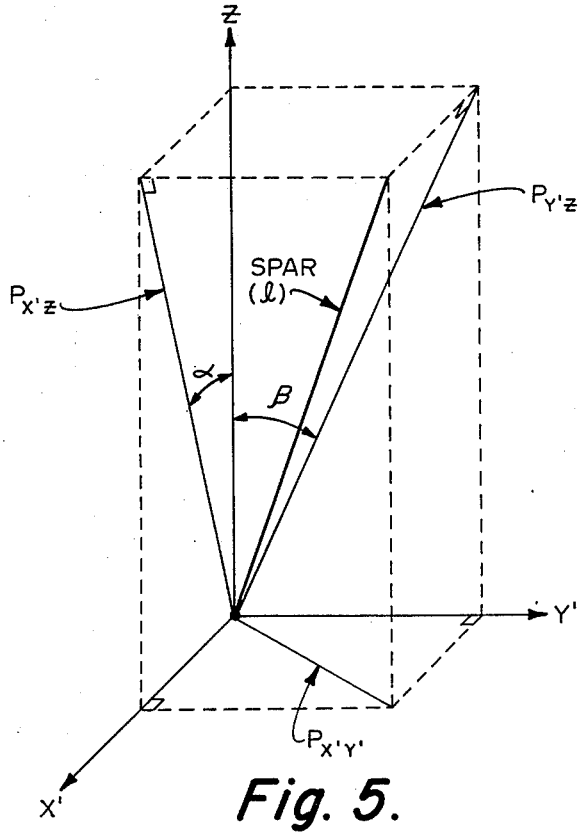

FIGS. 4 and 5 illustrate the calculation of the position of the bottom of the survey spar relative to the top of the spar when the spar is in a near vertical position and the location of the top of the spar is known. FIG. 4 is a top view where the X axis represents due east (magnetic) and Y axis represents due north (magnetic) and X'-Y' axes are oriented at an arbitrary angle relative to the X,Y coordinated system. The angle is the angle measured by the compass 42 of the spar's instrumentation and indicates the heading of the spar (i.e., the orientation of the anchor). Line PX'Y' represents the projection of the spar in the X'-Y' plane.

FIG. 5 shows the survey spar in the X',Y',Z coordinate system where PX'Y', PX'Z, and PY'Z represent the projections of the spar in the X'-Y' plane, the X'-Z plane, and the Y'-Z plane, respectively. The angles $\beta$ and $\alpha$ are the angles measured by the tilt potentiometers 44 and 46.

The relative position of the bottom of the spar with respect to the top of the spar in the X',Y' coordinate system can be shown to be $$X' = l \cos \beta \sin \alpha$$

$$Y' = l \cos \alpha \sin \beta,$$

where l is the length of the spar. These coordinates may then be converted to the X,Y coordinate system by rotating the X', Y' system through the appropriate angle $\Theta$ (as measured by the compass 42).

There are many possibilities for extending this survey spar system to other applications. One obvious variation is water depth. Depending on the sea state the survey spar system could be applied to water as shallow as the surfzone. The limiting factor would probably be the ability to control the spar or the tending support vessel so that sightings could be made accurately. In any event the use of instrumentation to provide a first approximation to the spar base offset would certainly be an improvement over just sighting on a moored float or uninstrumented staff.

Deep water useage would be limited by two factors; spar rigidity and handling, and diver access. Obviously as the depth increases, the tubular member becomes larger the air weight goes up and so does the cost. The operation becomes more like an offshore platform construction operation than a survey. It is likely, however, that by simply floating the spar horizontally, providing corrections for spar flexure in the presence of current and towing it to the site the present concept could probably be extended down to about 200 feet or so without major changes. Diver operations become much more complex, costly and risky in deeper water so either the spar must be limited to depths of under about 100 feet or it must be modified to provide its own mark on the bottom. Without divers to do final precise location of the anchor, the installation accuracy (although not the measurement accuracy) would also be degraded.

Obviously, many modifications and variations of the present invention are possible in the light of the above teachings. It is therefore to be understood that within the scope of the appended claims the invention may be practiced otherwise than as specifically described.

What is claimed is:

1. Survey spar system for use with conventional shore-based surface survey systems for accurately translating between a survey surface position and a position on the seafloor, which comprises:

a. anchor means for providing in-water weight to fix said survey spar system to a position on the seafloor in the presence of currents and waves;

b. a stiff, straight (buoyant) member, said member being long enough to extend from said anchor means to above the surface of the water;

c. means for providing a flexible connection between one end of said straight member and said anchor means;

d. means for maintaining said straight member in a substantially upright position so that the end not connected to said anchor means extends above the surface of the water; and e. means for determining the orientation of said straight member relative to said anchor means;

f. means for determining the heading of the anchor means in magnetic coordinates;

g. whereby the position of the end of said straight member coupled to said anchor means may be calculated when the position of the above the water end of the straight member is known.

2. Apparatus as recited in claim 1 wherein said means for maintaining said straight member in a substantially upright position includes: means for providing positive buoyancy in said straight member.

3. Apparatus as recited in claims 1 or 2 wherein said means for providing a flexible connection comprises:

connector means for transmitting tension and torsion loads between said straight member and said anchor while decoupling beam loads between said straight member and said anchor.

4. Apparatus as recited in claims 1 or 2 wherein said means for providing a flexible connection comprises:

a universal joint which allows the straight member to tilt with respect to the anchor means, but does not allow rotational movement about the longitudinal axis of said straight member.

5. Apparatus as recited in claim 4 wherein said means for determining the orientation of said straight member relative to said anchor means includes:

a. compass means for determining the heading of the anchor means;

b. means for measuring the tilt of said straight member relative to said anchor means.

6. Apparatus as recited in claim 5 wherein said means for measuring the tilt of said straight member includes:

first and second inclinometers, said first and second inclinometers disposed at 90 degrees relative to each other so as to measure the tilt of the straight member in two orthogonal planes.

7. A survey spar system for use with conventional shore-based surface survey systems for accurately translating between a surface position and a position on the seafloor, which comprises:

a. anchor means for providing in-water weight to fix said survey spar system to a position on the seafloor in the presence of currents and waves;

b. a straight member including a tubular section and a mast section, said tubular section being of sufficient rigidity to approximate a straight line in the presence of bending forces from current drag and wave action, said tubular section being long enough to extend from said anchor means to near the surface of the water, and said mast section extending above the surface of the water, said straight member having positive buoyancy;

c. a universal joint for connecting said anchor means to one end of said tubular section, said universal joint allowing said straight member to pivot in two orthogonal directions relative to said anchor, said universal joint preventing rotational movement between said anchor and said straight member about the longitudinal axis of the straight member, said universal joint thereby transmitting torsion loads and tension loads between said anchor and said straight member and decoupling beam loads;

d. means for determining the heading of the anchor means in magnetic earth coordinates;

e. means for determining the tilt of said straight member in two orthogonal directions;

f. whereby the position in earth coordinates of the end of said straight member coupled to said anchor means may be calculated when the position of the other end of said straight member is known in earth coordinates as may be determined by conventional surface survey techniques.

8. Apparatus as recited in claim 7 further including means for adjusting the buoyancy of said tubular section.

9. Apparatus as recited in claim 8 wherein said means for adjusting the buoyancy of said tubular section includes:

a. vent holes in said tubular section near the end coupled to said universal joint to permit water to flood the interior of said tubular section; and b. means disposed near the other end of said tubular section for introducing pressurized air into said tubular section to control the amount of water within said tubular section to thereby adjust the buoyancy of the tubular section.

10. Apparatus as recited in claims 8 or 9 wherein a plumb bob is attached by a plumb line to said other end of said tubular section, said plumb bob being suspended in said tubular section when said straight member is in a vertical orientation.

11. Apparatus as recited in claim 7 wherein said means for determining the heading of the anchor is a magnetic compass and said means for determining the tilt of said straight member in two orthogonal planes is a pair of inclinometers disposed at a right angle with respect to each other.

* * * * *